US006997244B2

(12) United States Patent
Hul-Chun

(10) Patent No.: US 6,997,244 B2
(45) Date of Patent: Feb. 14, 2006

(54) WICK STRUCTURE OF HEAT PIPE

(76) Inventor: Hsu Hul-Chun, 6F-3, No. 422, Sec. 2, Li-Ming Rd., Taichung (TW)

( * ) Notice: Subject to any disclaimer, the term of this patent is extended or adjusted under 35 U.S.C. 154(b) by 0 days.

(21) Appl. No.: 10/892,223

(22) Filed: Jul. 16, 2004

(65) Prior Publication Data

US 2006/0011328 A1 Jan. 19, 2006

(51) Int. Cl.
*F28D 15/00* (2006.01)

(52) U.S. Cl. ..... 165/104.26; 165/104.33; 361/700; 361/704; 257/715

(58) Field of Classification Search ..... 165/80.3, 165/185, 80.4, 104.21, 104.26, 104.33; 361/700; 257/714–716; 174/15.2
See application file for complete search history.

(56) References Cited

U.S. PATENT DOCUMENTS 3,840,069 A * 10/1974 Fischer et al. ..... 165/104.26
3,857,441 A * 12/1974 Arcella ..... 165/104.26
3,901,311 A * 8/1975 Kosson et al. ..... 165/104.26
5,412,535 A * 5/1995 Chao et al. ..... 361/700
5,632,158 A * 5/1997 Tajima ..... 62/259.2
6,427,765 B1 * 8/2002 Han et al. ..... 165/104.26
6,648,063 B1 * 11/2003 Andraka et al. ..... 165/104.26
6,725,909 B1 * 4/2004 Luo ..... 165/104.21
6,738,257 B1 * 5/2004 Lai ..... 361/700
6,793,009 B1 * 9/2004 Sarraf ..... 165/104.33

* cited by examiner

*Primary Examiner*—Terrell Mckinnon

(57) ABSTRACT

A composite wick structure of a heat pipe which is applied with a tube circumferential surface contacted to a heat source includes a plurality of grooves and a sintered-powder layer. The grooves are longitudinally formed on the internal sidewall of the tubular member. The sintered-powder layer filled in the grooves is attached to at least a portion of the internal sidewall of the tubular member. By the better capillary force provided by the sintered powder, the liquid-phase working fluid can reflow to the bottom side of the heat pipe quickly to enhance the heat transmission efficiency. Further, the problem caused by usage of an axial rod during the process of applying sintered powder can be resolved.

8 Claims, 3 Drawing Sheets

WICK STRUCTURE OF HEAT PIPE

BACKGROUND OF THE INVENTION

The present invention relates in general to a wick structure of a heat pipe, and more particularly, to a composite wick structure of a heat pipe having a tube circumferential surface in contact with a heat source, and the wick structure including a plurality of grooves and a sintered-powder attachment.

Having the features of high heat transmission capability, high-speed heat conductance, high thermal conductivity, light weight, mobile-elements free, simple structure, the versatile application, and low power for heat transmission, heat pipes have been popularly applied in heat dissipation devices in the industry. The conventional heat pipe includes a wick structure on an internal sidewall of the tubular member. The wick structure typically includes the sintered powder to aid in transmission of working fluid.

The fine and dense structure of the powder-sintered wick structure provides better capillary force for reflow of the liquid-state working fluid. However, during fabrication, an axial rod has to be inserted into the tubular member to serve as a support member of the wick structure during the sintering process, so as to avoid collapse of the powder which has not been sintered yet. Therefore, normally the thickness of the sintered powder wick structure is thicker. Consequently, the capillary thermal resistance is increased to be disadvantageous for the heat transmission. Further, requirement of the axial rod hinders the mass production of the heat pipe and causes fabrication and quality issues of the heat pipe.

Thus, there still is a need in the art to address the aforementioned deficiencies and inadequacies.

BRIEF SUMMARY OF THE INVENTION

The present invention provides a composite wick structure of a heat pipe. The heat pipe is applied by a tube circumferential surface in contact with a heat source. The composite wick structure includes a plurality of grooves and a sintered-powder attachment, such that the transmission capability of the wick structure is maintained, and the heat conduction performance of the heat pipe is improved, while the problems with the caused by the axial rod are resolved.

Accordingly, the heat pipe includes a tubular member and a wick structure having a plurality of grooves and a sintered-powder layer. The grooves are longitudinally formed on the internal sidewall of the tubular member. The sintered-powder layer filled in the grooves is attached to at least a portion of the internal sidewall of the tubular member.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
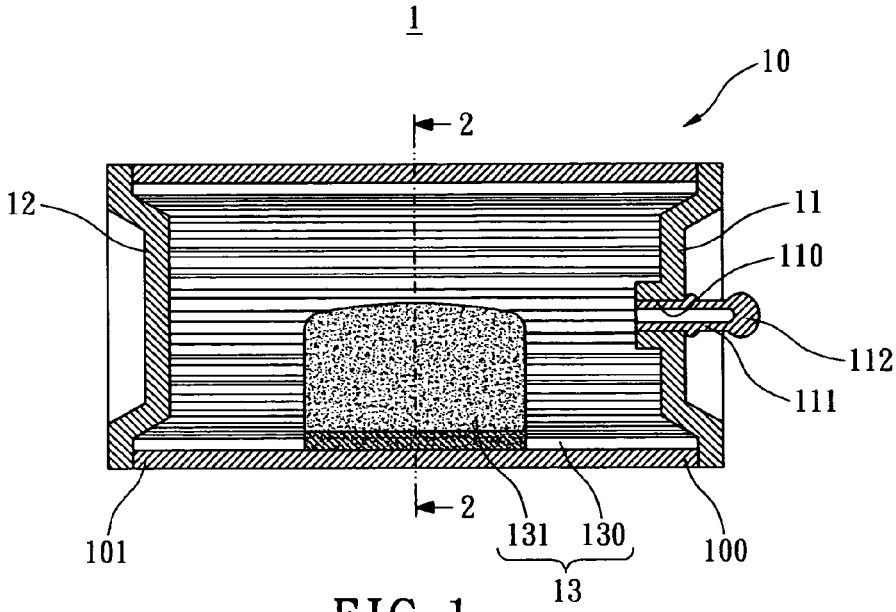
FIG. 1 shows a cross sectional view of a heat pipe according to the present invention.

Referring now to the drawings wherein the showings are for purpose of illustrating preferred embodiments of the present invention only, and not for purposes of limiting the same, FIG. 1 illustrates a cross sectional view of a heat pipe 1 which includes a tubular member 10, a first lid 11 and a bottom lid 12.

The tubular member 10 is preferably in the form of a cylindrical hollow tube having two open ends 100 and 101. The open end 100 is covered with the first lid 11, while the other open end 101 is covered with the bottom lid 12. The first lid 111 and the bottom lip 12 can be made by pressing plates so that the tubular member 10 can be closed and sealed thereby. Moreover, the first lid 11 has a hole 110 extending therethrough allowing a filling pipe 111 to extend into the tubular member 10 for filling an adequate amount of working fluid inside the tubular member 10. By subsequent process such as vacuuming, the tubular member 10 is sealed by tin wetting or spot welding to form a sealed portion 112.

Figure 2:
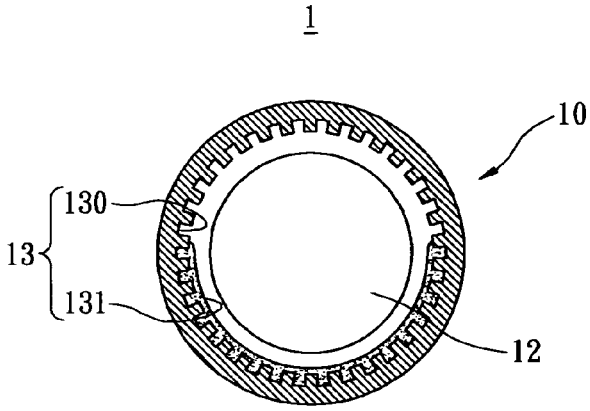
FIG. 2 shows a cross sectional view along line 2—2 of FIG. 1 in one preferred embodiment.

Please refer to FIG. 2 together. As shown, a wick structure 13 is attached to the internal sidewall of the tubular member 10. The wick structure 13 includes a plurality of longitudinal grooves 130 and a sintered-powder layer 131. The grooves 130 are radially arranged on whole internal sidewall of the tubular member 10. The sintered-powder layer 131 is formed on at least a portion of the grooves 130. Preferably, the sintered-powder layer 131 extends an elongate direction of the tubular member 10 at the center, as shown in FIG. 1, and partially covers around and fills in the grooves 130, as shown in FIG. 2. As the sintered-powder layer 131 does not have to cover the whole grooves 130, the axial rod is not required. To form the sintered-powder layer 131, powder to be sintered is disposed inside of the tubular member 10. The tubular member 10 is laid down with the side at which sintered-powder layer 131 facing downwardly for performing sintering.

Figure 3:
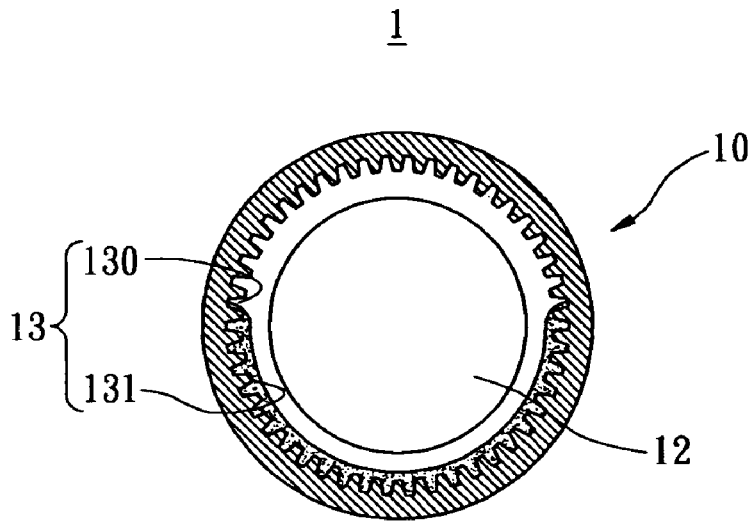
FIG. 3 shows a cross sectional view along line 2—2 of FIG. 1 in another preferred embodiment.
Figure 4:
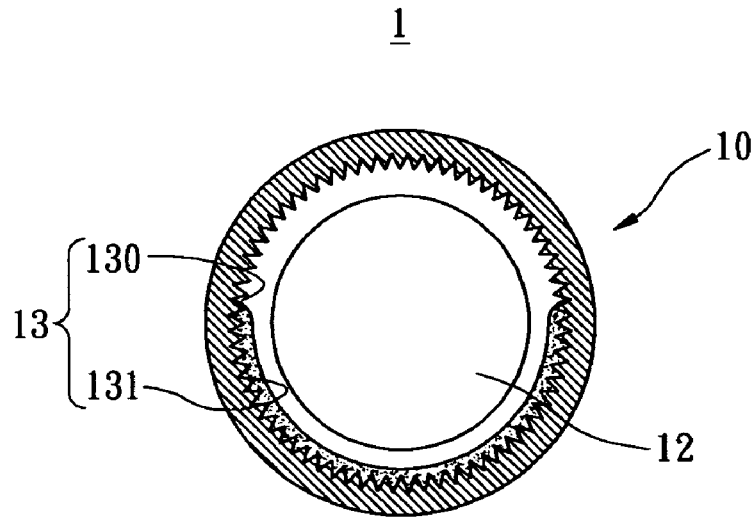
FIG. 4 shows a cross sectional view along line 2—2 of FIG. 1 in still another preferred embodiment.

In one preferred embodiment as shown in FIG. 2, each groove 130 has a dented rectangular shape in a cross sectional view along the radial direction of the tubular member 10. However, in other embodiments as shown in FIG. 3 or FIG. 4, the grooves 130 can be tapered to have trapezoidal or triangular shapes, respectively.

Figure 5:
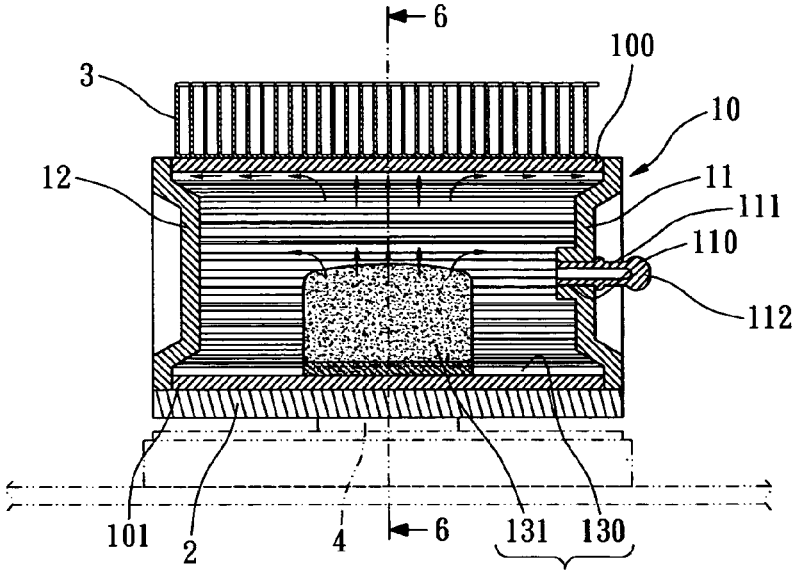
FIG. 5 shows a cross sectional view of a heat pipe in application.
Figure 6:
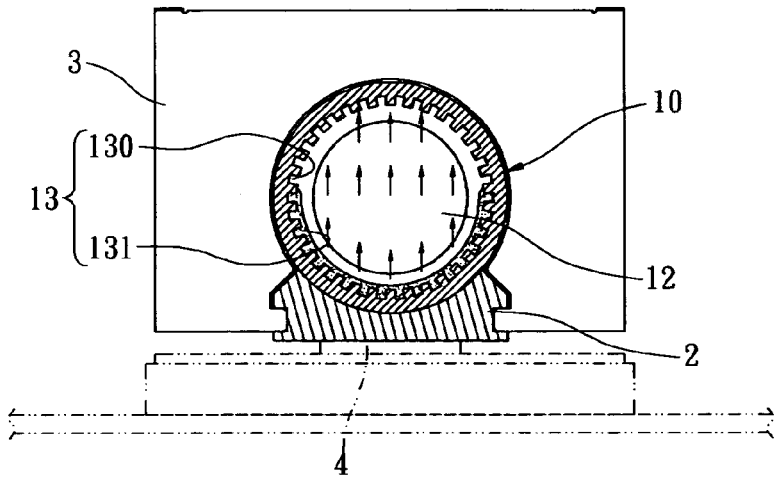
FIG. 6 shows a cross sectional view along line 6—6 of FIG. 5.

FIG. 5 shows a cross sectional of the heat pipe in operation and FIG. 6 shows a cross sectional view along line 6—6 of FIG. 5. As shown, the heat pipe 1 is laid down to be attached on a heat conductive plate 2, and a plurality of heat dissipating fins 3 are mounted on the heat pipe 1. The heat conductive plate 2 is in contact with a heat source 4 where the sintered powder 131 of the wick structure 13 in the heat pipe 1 is located corresponding thereto. When the heat source 4 starts to generate heat, the working fluid in the heat pipe absorbs the heat and is evaporated into gas. The gas then rises up to the upper side of the heat pipe 1 and flows along the grooves 130 towards the first and the second lids

11 and 12 to be condensed into liquid and reflow to bottom side of the tubular member 10 adjacent to the heat conductive plate 2. Meanwhile, the sintered-powder layer 131 corresponding the heat source 4 has the better capillary effect to instantly absorb the work fluid due to the sintered powder can provide faster liquid flowing. Thereby, the reflow speed of the working fluid is greatly increased to enhance the heat transmission efficiency.

This disclosure provides exemplary embodiments of wick structure of a heat pipe. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

The invention claimed is:

1. A heat pipe comprising:

a tubular member with a circumferential surface that a portion of the circumferential surface is closely fitted and attached on a heat conductive plate which will be used to get in contact with a heat source;

a wick structure including a plurality of longitudinal grooves formed on the internal sidewall of the tubular member, and a sintered-powder layer filled in and attached to at least a portion of the grooves located around the middle area where the circumferential surface is attached on the heat conductive plate;

a plurality of heat dissipating fins are attached to the tubular member and the heat conductive plate by a notched portion in said heat conductive plate.

2. The heat pipe of claim 1, wherein the tubular member comprises two opposing ends covered with a first lid and a second lid respectively.

3. The heat pipe of claim 2, wherein the first lid includes a filling tube penetrated therethrough.

4. The heat pipe of claim 3, wherein the filling tube and the first lid are integrally formed.

5. The heat pipe of claim 4, wherein the first lid includes a sealed portion to seal the filling tube.

6. The heat pipe of claim 1, wherein each of the grooves has a dented rectangular shape.

7. The heat pipe of claim 1, wherein each of the grooves has a dented trapezoidal shape.

8. The heat pipe of claim 1, wherein each of the grooves has a dented triangular shape.

* * * * *